US007699665B1

(12) United States Patent
Yin

(10) Patent No.: US 7,699,665 B1
(45) Date of Patent: Apr. 20, 2010

(54) AUDIO PLUG CONNECTOR

(75) Inventor: Te-Hung Yin, Taipei Hsien (TW)

(73) Assignee: Cheng Uei Precision Industry Co., Ltd., Taipei Hsien (TW)

( * ) Notice: Subject to any disclaimer, the term of this patent is extended or adjusted under 35 U.S.C. 154(b) by 0 days.

(21) Appl. No.: 12/263,226

(22) Filed: Oct. 31, 2008

(51) Int. Cl.
*H01R 24/04* (2006.01)

(52) U.S. Cl. ..... 439/669

(58) Field of Classification Search ..... 439/669, 439/660, 668, 675, 188, 357, 76.1
See application file for complete search history.

(56) References Cited

U.S. PATENT DOCUMENTS 6,609,931 B2 * 8/2003 Parrish et al. ..... 439/578
6,705,901 B1 * 3/2004 Lin ..... 439/668
6,755,694 B2 * 6/2004 Ries et al. ..... 439/668
7,534,146 B2 * 5/2009 Chien et al. ..... 439/668
7,553,195 B2 * 6/2009 Matsumoto et al. ..... 439/669
7,573,724 B2 * 8/2009 Hur ..... 361/785

* cited by examiner

*Primary Examiner*—Jean F Duverne
(74) *Attorney, Agent, or Firm*—WPAT, P.C.; Anthony King; Kay Yang

(57) ABSTRACT

An audio plug connector includes a substantially pillared insulating body defining a fixing portion at one end thereof, a plurality of terminals formed in the insulating body, and a housing having a lower housing and an upper housing mated with each other to define a cylindrical receiving space therebetween for receiving the one end of the insulating body therein. The fixing portion defines at least one fixing hole passing therethrough. A portion of an inner surface of the lower housing protrudes corresponding to the fixing hole to form at least one locating portion inserted in the corresponding fixing hole. A portion of an inner surface of the upper housing protrudes corresponding to the locating portion to form at least one propping projection which defines a locating hole. A free end of the locating portion is further inserted in the corresponding locating hole.

2 Claims, 3 Drawing Sheets

AUDIO PLUG CONNECTOR

BACKGROUND OF THE INVENTION

1. Field of the Invention

The present invention generally relates to an audio connector, and more particularly to an audio plug connector.

2. The Related Art

A conventional audio electronic product such as an earphone and a microphone usually includes an audio plug connector. The audio plug connector is inserted in a matching audio receptacle connector so as to make audio signals transmitted therebetween. The audio plug connector has a substantially pillared connector body and a housing for receiving a rear of the connector body therein. However, as the rear of the connector body is generally pillared, as a result, the connector body is difficult to be right located and firmly fixed in the housing during being manufactured that causes the manufacturing efficiency and quality to be reduced.

SUMMARY OF THE INVENTION

An object of the present invention is to provide an audio plug connector which includes a substantially pillared insulating body defining a fixing portion at one end thereof, a plurality of terminals formed in the insulating body, and a housing having a lower housing and an upper housing mated with each other to define a cylindrical receiving space therebetween for receiving the one end of the insulating body therein. The fixing portion defines at least one fixing hole passing therethrough. A portion of an inner surface of the lower housing protrudes corresponding to the fixing hole to form at least one locating portion inserted in the corresponding fixing hole. A portion of an inner surface of the upper housing protrudes corresponding to the locating portion to form at least one propping projection which defines a locating hole. A free end of the locating portion is further inserted in the corresponding locating hole.

As described above, the locating portion of the lower housing is inserted into the corresponding fixing hole of the fixing portion and the corresponding locating hole of the upper housing, so the insulating body can be right located and firmly fixed in the housing during being manufactured that further improves the manufacturing efficiency and quality.

BRIEF DESCRIPTION OF THE DRAWINGS

The present invention will be apparent to those skilled in the art by reading the following description of a preferred embodiment thereof, with reference to the attached drawings, in which.

DETAILED DESCRIPTION OF THE PREFERRED EMBODIMENT

Figure 1:
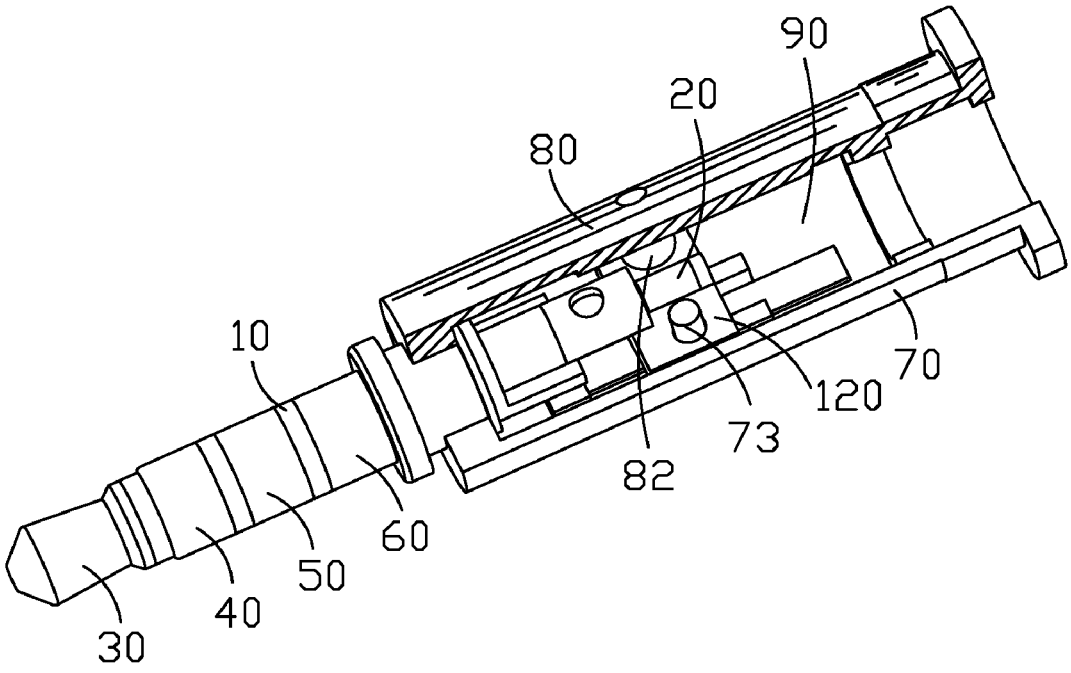
FIG. 1 is a perspective view of an audio plug connector according to the present invention, wherein an upper housing is partially cut open.
Figure 2:
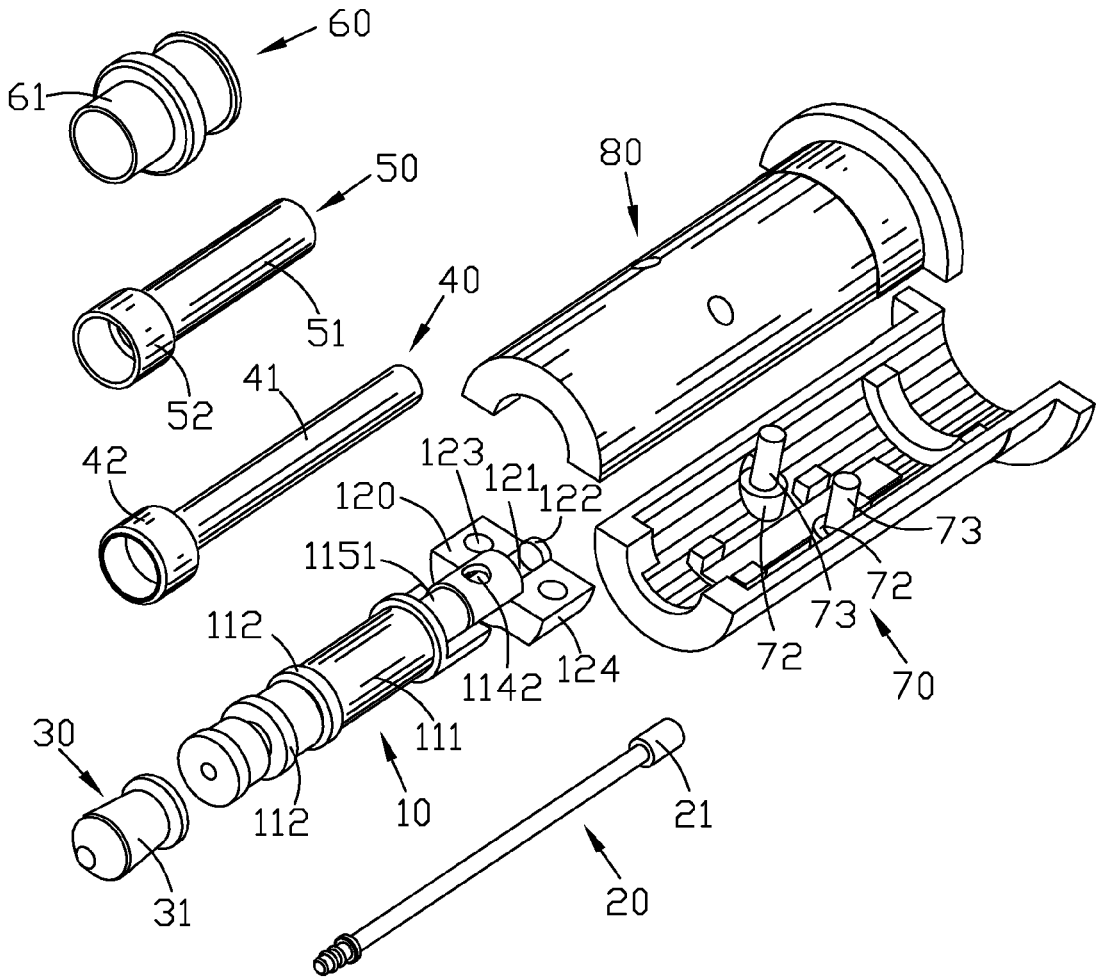
FIG. 2 is an exploded perspective view of the audio plug connector of FIG. 1.

With reference to FIG. 1 and FIG. 2, an audio plug connector of the present invention includes a connector body and a housing for receiving a rear of the connector body therein.

The connector body includes an insulating body 10, a connecting terminal 20, a first terminal 30, a second terminal 40, a third terminal 50 and a fourth terminal 60.

Figure 3:
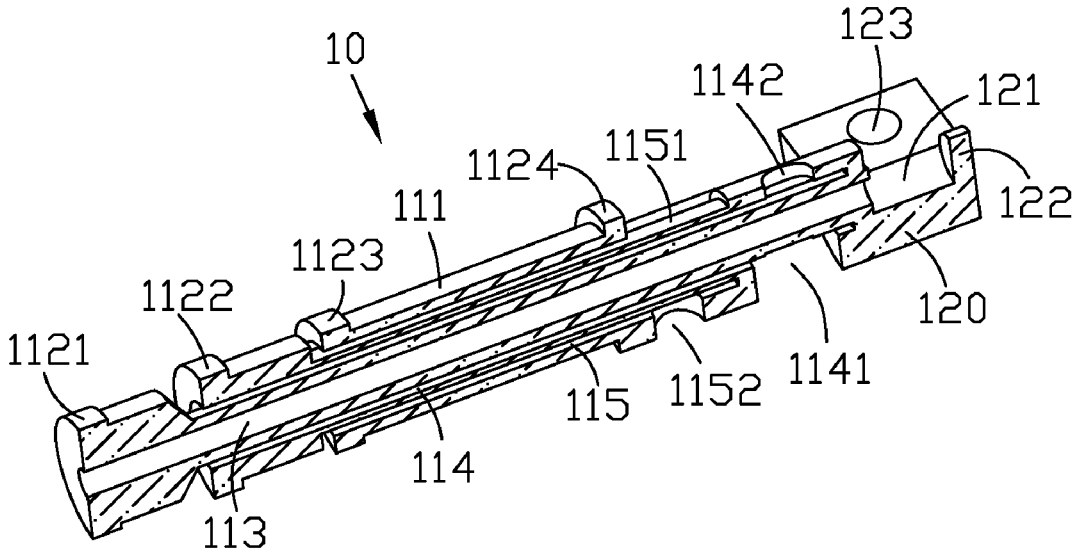
FIG. 3 is a perspective sectional view of an insulating body of the audio plug connector of FIG. 1.

Referring to FIGS. 2 and 3, the insulating body 10 has a substantially pillared base portion 111 extending longitudinally. An outside of the base portion 111 protrudes therearound to form four preventing portions 112 apart from each other. The preventing portions 112 are sequentially defined as a first preventing portion 1121, a second preventing portion 1122, a third preventing portion 1123 and a fourth preventing portion 1124 from front to rear. The base portion 111 defines a pillared first receiving recess 113 in a middle thereof penetrating from front to rear, a cylindrical second receiving recess 114 around the first receiving recess 113 having a front end passing through the base portion 111 and adjacent to a front of the second preventing portion 1122, and a cylindrical third receiving recess 115 around the second receiving recess 114 having a front end passing through the base portion 111 and adjacent to a front of the third preventing portion 1123. The receiving recesses 113, 114, 115 are coaxial with the base portion 111. A rear of the second receiving recess 114 communicates with the outside through a first gap 1141 at bottom and a first aperture 1142 at top. A rear of the third receiving recess 115 communicates with the outside through a second gap 1151 at top and a second aperture 1152 at bottom. The second gap 1151 and the second aperture 1152 are located behind the fourth preventing portion 1124 and in front of the first aperture 1142 and the first gap 1141.

The insulating body 10 further has a substantially rectangular fixing portion 120 disposed levelly and having a front connected with a rear of the base portion 111 at bottom. A middle of a top of the fixing portion 120 defines a receiving cavity 121 extending longitudinally and communicating with the first receiving recess 113. A rear of the fixing portion 120 protrudes upward into the receiving cavity 121 to form a preventing block 122. The fixing portion 120 further defines two pillared fixing holes 123 vertically passing therethrough and respectively located at two sides of the receiving cavity 121. Two opposite sides of the fixing portion 120 respectively defines an arc-shaped propping surface 124.

Referring to FIGS. 1-3, the terminals are integrally formed with the insulating body 10 to form the connector body. The connecting terminal 20 is integrally formed in the first receiving recess 113 and has a first connecting portion 21 at rear partially received in the receiving cavity 121 to be connected with external elements (not shown) and abutting against the preventing block 122. The first terminal 30 abuts against a front of the insulating body 10 via a front of the connecting terminal 20 integrally formed therein and has a conical first contacting portion 31. The second terminal 40 has a cylindrical second connecting portion 41 integrally formed in the second receiving recess 114 and a cylindrical second contacting portion 42 connected with a front of the second connecting portion 41 and wrapping the base portion 111 between the first preventing portion 1121 and the second preventing portion 1122. The third terminal 50 has a cylindrical third connecting portion 51 integrally formed in the third receiving recess 115 and a cylindrical third contacting portion 52 connected with a front of the third connecting portion 51 and wrapping the base portion 111 between the second preventing portion 1122 and the third preventing portion 1123. The fourth terminal 60 is cylindrical to wrap the base portion 111 between the third preventing portion 1123 and the fourth preventing portion 1124, and has a fourth contacting portion

61 at front. A rear of the second connecting portion 41 is exposed via the first gap 1141 and the first aperture 1142 so as to be connected with the external elements. A rear of the third connecting portion 51 is exposed via the second gap 1151 and the second aperture 1152 so as to be connected with the external elements.

Figure 4:
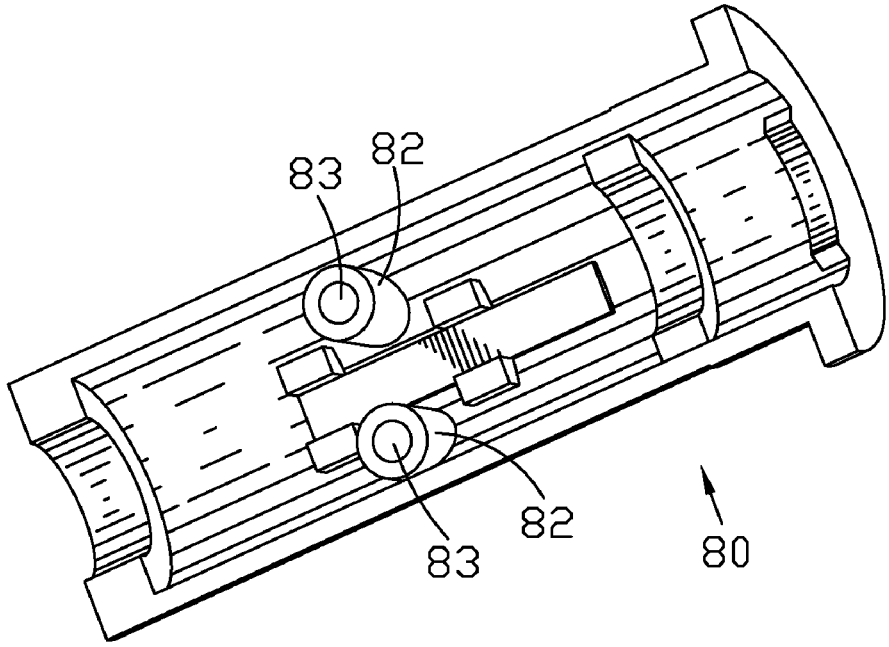
FIG. 4 is a perspective view of the upper housing of the audio plug connector of FIG. 1.

Referring to FIG. 1, FIG. 2 and FIG. 4, the housing includes a semi-cylindrical lower housing 70 and a semi-cylindrical upper housing 80 mating with each other to define a cylindrical receiving space 90 therebetween. An inside of the lower housing 70 protrudes upward to form two pillared propping portions 72. A top of each of the propping portions 72 protrudes upward to form a pillared locating portion 73 corresponding to the respective fixing hole 123 of the insulating body 10. An inside of the upper housing 80 protrudes downward to form two pillared propping projections 82 facing to the corresponding propping portions 72. Each of the propping projections 82 defines a pillared locating hole 83 mating with the corresponding locating portion 73. The rear of the connector body is received in the receiving space 90 of the housing. The locating portions 73 of the lower housing 70 are inserted into the corresponding fixing holes 123 of the fixing portion 120 and a top of each of the locating portions 73 is further inserted in the corresponding locating hole 83 of the upper housing 80. The propping portions 72 and the propping projections 82 respectively abut against a bottom and a top of the fixing portion 120 to firmly clip the fixing portion 120 therebetween. The propping surfaces 124 of the fixing portion 120 abut against the inside of the housing.

As described above, the locating portions 73 of the lower housing 70 are inserted into the corresponding fixing holes 123 of the fixing portion 120 and the corresponding locating holes 83 of the upper housing 80, and the fixing portion 120 is clipped between the propping portions 72 and the propping projections 82, so the connector body can be right located and firmly fixed in the housing during being manufactured that further improves the manufacturing efficiency and quality.

What is claimed is:

1. An audio plug connector, comprising:

an insulating body of substantially pillared shape defining a fixing portion at one end thereof, the fixing portion defining at least one fixing hole passing therethrough;

a plurality of terminals formed in the insulating body; and a housing having a lower housing and an upper housing mated with each other to define a cylindrical receiving space therebetween for receiving the one end of the insulating body therein, a portion of an inner surface of the lower housing protruding corresponding to the fixing hole of the fixing portion to form at least one locating portion inserted in the corresponding fixing hole, a portion of an inner surface of the upper housing protruding corresponding to the locating portion to form at least one propping projection which defines a locating hole, a free end of the locating portion being further inserted in the corresponding locating hole;

wherein the fixing portion is substantially rectangular and extends beyond two opposite sides of the one end of the insulating body, two opposite sides of the fixing portion respectively define an arc-shaped propping surface abutting against the inner surface of the housing;

wherein the fixing portion further defines a receiving cavity thereon, the terminals include a connecting terminal having one end stretching out of the one end of the insulating body and partially received in the receiving cavity, the fixing holes are respectively located at two sides of the receiving cavity;

wherein the fixing portion protrudes into the receiving cavity to form a preventing block abutting against the one end of the connecting terminal.

2. The audio plug connector as claimed in claim 1, wherein a portion of the inner surface of the lower housing protrudes to form at least one propping portion corresponding to the propping projection, the locating portion extends from the corresponding propping portion, the propping portion and the propping projection clip the fixing portion therebetween.

* * * * *